US007808354B2

(12) United States Patent
Yuan et al.

(10) Patent No.: US 7,808,354 B2
(45) Date of Patent: Oct. 5, 2010

(54) MAGNETIC ELEMENT

(75) Inventors: Xiao-Xia Yuan, Taoyuan Hsien (TW); Shao-Dong Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/363,192

(22) Filed: Jan. 30, 2009

(65) Prior Publication Data

US 2010/0134231 A1 Jun. 3, 2010

(30) Foreign Application Priority Data

Dec. 2, 2008 (TW) ..... 97146691 A

(51) Int. Cl.
*H01F 27/28* (2006.01)
*H01F 27/34* (2006.01)

(52) U.S. Cl. ..... 336/180; 336/182; 336/170

(58) Field of Classification Search ..... 336/180, 336/181, 183, 170–171
See application file for complete search history.

(56) References Cited

U.S. PATENT DOCUMENTS

| | | | | |
|---|---|---|---|---|
| 4,816,784 | A * | 3/1989 | Rabjohn | 333/24 R |
| 7,355,307 | B2 * | 4/2008 | Steinmeyer | 310/52 |
| 7,573,363 | B2 * | 8/2009 | Yamashita | 336/229 |
| 2008/0094164 | A1 * | 4/2008 | Hsu | 336/200 |

* cited by examiner

*Primary Examiner*—Anh T Mai
(74) *Attorney, Agent, or Firm*—Muncy, Geissler, Olds & Lowe, PLLC

(57) ABSTRACT

A magnetic element includes a first wire, a second wire, a third wire, a fourth wire and a first single-strand wire. The first wire is disposed at a first side of the magnetic element, and has a first end and a second end. The second wire is disposed at the first side of the magnetic element, and has a third end and a fourth end. The third wire is disposed at a second side of the magnetic element, and has a fifth end and a sixth end. The fourth wire is disposed at the second side of the magnetic element, and has a seventh end an eighth end. The first single-strand wire has one terminal simultaneously connected to the second end and the fourth end.

11 Claims, 1 Drawing Sheet

MAGNETIC ELEMENT

CROSS REFERENCE TO RELATED APPLICATIONS

This Non-provisional application claims priority under 35 U.S.C. §119(a) on Patent Application No(s). 097146691 filed in Taiwan, Republic of China on Dec. 2, 2008, the entire contents of which are hereby incorporated by reference.

BACKGROUND OF THE INVENTION

1. Field of Invention

The present invention relates to a magnetic element capable of reducing its internal parasitic capacitance and inductance leakage, and having high reliability, high product yield and low manufacturing cost.

2. Related Art

Nowadays, the primary and secondary winding of a magnetic element respectively includes two wires for induction, and three pins, wherein three pins are one end of the first wire, one end of the second wire, and one terminal of a multi-strand wire formed by the other ends of the first and second wires, respectively.

However, when the signals of the magnetic element are transmitted through the multi-strand wire, the multi-stand wire will induce internal parasitic capacitance and inductance leakage due to different wire distance, materials and signals of the two wires. Moreover, the EMI/EMS or IEEE performance will be worsened.

Furthermore, when the multi-strand wire is soldered onto an external printed circuit board, it is difficult to precisely solder the multi-strand wire onto the printed circuit board such that the soldering reliability and the product quality are reduced. Then, extra tests and repair processes will be required, thereby increasing manufacturing cost greatly.

SUMMARY OF THE INVENTION

An object of the present invention is to provide a magnetic element capable of reducing its internal parasitic capacitance and inductance leakage so as to increase the reliability, the product yield and reduce the manufacturing cost.

To achieve the above, the present invention is to provide a magnetic element including: a first wire disposed at a first side of the magnetic element and having a first end and a second end, a second wire disposed at the first side of the magnetic element and having a third end and a fourth end, a third wire disposed at a second side of the magnetic element and having a fifth end and sixth end, a fourth wire disposed at the second side of the magnetic element and having a seventh end and an eighth end, and a single-strand wire having one terminal connected to the second end and the fourth end simultaneously.

To achieve the above, the present invention also provides a magnetic element including: a first wire disposed at a first side of the magnetic element, a second wire disposed at a second side of the magnetic element, and a first single-strand wire having one terminal connected to a central point of the first wire.

To sum up, in the above-mentioned magnetic elements, the wires at the terminals and induction portions of the magnetic elements are single-strand wires. Therefore, during signal transmission, the magnetic element will not cause internal parasitic capacitance and inductance leakage. It will increase the reliability and the product yield and reduce its manufacturing cost.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

Figure 1:
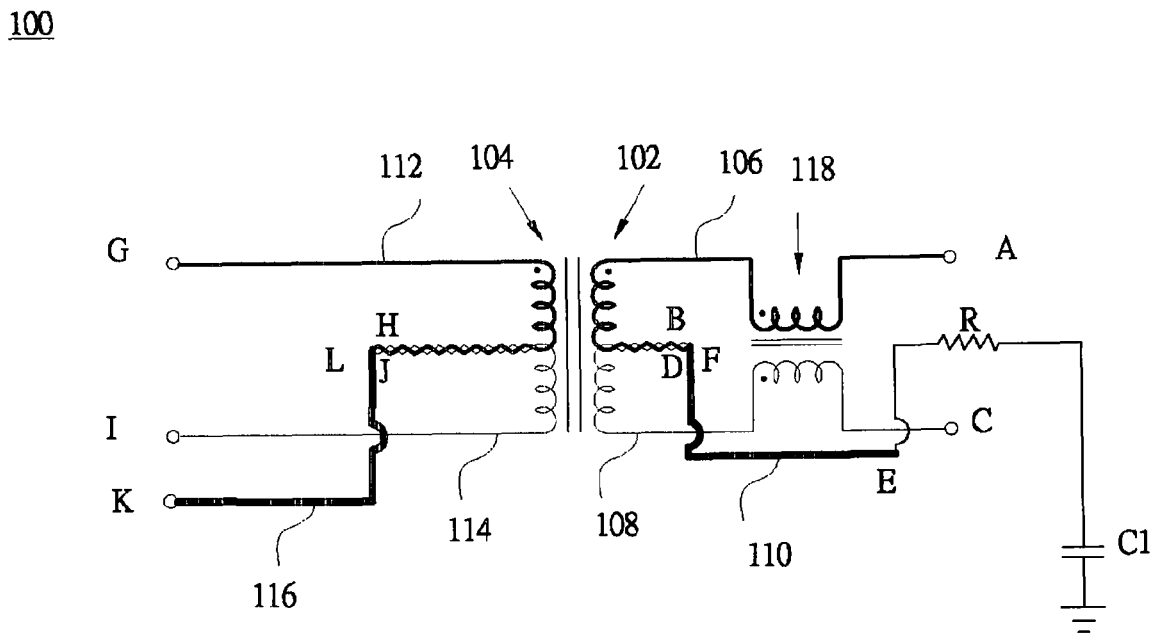
FIG. 1 is a circuit diagram of a magnetic element of the present invention.

The present invention will be apparent from the following detailed description, which proceeds with reference to the accompanying drawing.

FIG. 1 is a circuit diagram of a magnetic element of the present invention. As shown in FIG. 1, the magnetic element 100 includes a first wire 106, a second wire 108, a third wire 112, a fourth wire 114 and a first single-strand wire 110. The magnetic element 100 has a first side 102 and a second side 104. The magnetic element 100 can be a transformer or an inductor.

The first wire is disposed at the first side 102, and has a first end A and a second end B. The first end A serves as a pin of the first side 102. The first wire 106 can be a single-strand wire or a multi-strand wire.

The second wire is disposed at the first side 102, and has a third end C and a fourth end D. The third end C serves as another pin of the first side. The second wire 108 can be a single-strand wire or a multi-strand wire.

One terminal F of the first single strand wire 110 is electrically connected to the second end B and the fourth end D simultaneously. The other terminal E of the first single strand wire 110 serves as a common tap pin of the magnetic element 100. The first single-strand wire 110 is a single-strand wire. Therefore, the signal transmitted in the first single-strand wire 110 from the first wire 106, the second wire 108 and outside circuit will not cause internal parasitic capacitance and inductance leakage.

The third wire 112 is disposed at the second side 104, and has a fifth end G and a sixth end H. The fifth end G serves as a pin of the second side 104. The third wire 112 can be a single-strand wire or a multi-strand wire.

The fourth wire 114 is disposed at the second side 104, and has a seventh end I and a eighth end J. The seventh end I serves as another pin of the second side 104. The fourth wire 114 can be a single-strand wire or a multi-strand wire.

Furthermore, the magnetic element 100 further includes a second single-strand wire 116. One terminal L of the second single-strand wire 116 is simultaneously electrically connected to the sixth end H and the eighth end J. The other terminal K of the second single-strand wire 116 serves as a common tap pin of the second side 104. Thus, the signals transmitted in the second single-strand wire 116 from the third wire 112, the fourth wire 114 and outside circuit will not cause internal parasitic capacitance and inductance leakage.

Furthermore, in a preferred embodiment of the present invention, a portion of the first wire 106 and a portion of the second wire 108 can constitute a choke structure. A portion of the third wire 112 and a portion of the fourth wire 114 can constitute another choke structure according to the actual requirement.

Furthermore, the first wire 106 and the second wire 108 can be replaced by a single wire. The ends A and C will be two ends of the single wire. The connecting point of the ends B and D is a central point of the singe wire. Similarly, the third wire 112 and the fourth wire 114 can be replaced by a single wire. Therefore, the ends G and I are two ends of the another single wire. The connecting point of the ends H and J is a central point of the another single wire.

Furthermore, in the preferred embodiment of the present invention, the first single-strand wire 110 can be directly or indirectly connected to a resistor R or a capacitor C1. The first wire 106, the second wire 108, the third wire 112, the fourth wire 114 or the second single-strand wire 116 can be directly or indirectly connected to the resistor R or the capacitor C1.

To sum up, in the present invention, the wires at the induction portions and pins of the magnetic element are all single-strand wires. The signals transmitted in the magnetic element will not cause internal parasitic capacitance and inductance leakage so as to increase the reliability and the product yield, and decrease its manufacturing cost.

Although the present invention has been described with reference to specific embodiment, this description is not meant to be construed in a limiting sense. Various modifications of the disclosed embodiment, as well as alternative embodiments, will be apparent to persons skilled in the art. It is, therefore, contemplated that the appended claims will cover all modifications that fall within the true scope of the present invention.

What is claimed is:

1. A magnetic element comprising:

a first wire disposed at a first side of the magnetic element and having a first end and a second end;

a second wire disposed at the first side of the magnetic element and having a third end and a fourth end;

a third wire disposed at a second side of the magnetic element and having a fifth end and a sixth end;

a fourth wire disposed at the second side of the magnetic element and having a seventh end and eighth end; and a single-strand wire having one terminal connected to the second end and the fourth end simultaneously.

2. The magnetic element according to claim 1, further comprising a second single-strand wire having one terminal connected to the sixth end and the eighth end simultaneously.

3. The magnetic element according to claim 2, wherein the fifth end, the seventh end and the other terminal of the second single-strand wire serve as pins at the second side.

4. The magnetic element according to claim 2, wherein the other terminal of the first single-strand wire or the other terminal of the second single-strand wire serves as a common tap pin.

5. The magnetic element according to claim 2, wherein the first wire, the second wire, the third wire, the fourth wire, the first single-strand wire or the second single-strand wire is directly or indirectly connected to a resistor or a capacitor.

6. The magnetic element according to claim 1, wherein the first end, the third end and the other terminal of the first single-strand wire serve as pins at the first side.

7. The magnetic element according to claim 1, wherein the first end, the second end or the first single-strand wire is directly or indirectly connected to a resistor or a capacitor.

8. The magnetic element according to claim 1, wherein a portion of the third wire and a portion of the fourth wire constitute a choke structure.

9. The magnetic element according to claim 1, wherein a portion of the first wire and a portion of the second wire constitute a choke structure.

10. The magnetic element according to claim 1, being a transformer or an inductor.

11. The magnetic element according to claim 1, wherein the first wire, the second wire, the third wire or the fourth wire is a single-strand wire or a multi-strand wire.

* * * * *